US008210661B2

(12) United States Patent
Cheung et al.

(10) Patent No.: US 8,210,661 B2
(45) Date of Patent: Jul. 3, 2012

(54) STACKED SLICE PRINTHEAD

(75) Inventors: Patrick C. P. Cheung, Castro Valley, CA (US); Karl A. Littau, Palo Alto, CA (US); Michael Y. Young, Cupertino, CA (US); Steven A. Buhler, Sunnyvale, CA (US)

(73) Assignee: Palo Alto Research Center, Incorporated, Palo Alto, CA (US)

( * ) Notice: Subject to any disclaimer, the term of this patent is extended or adjusted under 35 U.S.C. 154(b) by 379 days.

(21) Appl. No.: 12/639,347

(22) Filed: Dec. 16, 2009

(65) Prior Publication Data

US 2011/0141206 A1 Jun. 16, 2011

(51) Int. Cl.
*B41J 2/045* (2006.01)

(52) U.S. Cl. ..... 347/71

(58) Field of Classification Search ..... 347/68, 347/69, 70, 71, 72, 40, 42, 43, 47, 48; 400/124.14, 400/124.16; 310/311, 324, 327, 328, 365
See application file for complete search history.

(56) References Cited

U.S. PATENT DOCUMENTS

| | | | | |
|---|---|---|---|---|
| 5,850,240 | A | 12/1998 | Kubatzki et al. | |
| 6,437,487 | B1 * | 8/2002 | Mohr et al. | 310/365 |
| 6,601,948 | B1 * | 8/2003 | Zhang | 347/68 |
| 7,347,533 | B2 | 3/2008 | Elrod et al. | |
| 2001/0022489 | A1 * | 9/2001 | Seipler et al. | 310/366 |
| 2004/0119379 | A1 * | 6/2004 | Lee et al. | 310/365 |

* cited by examiner

*Primary Examiner* — Kristal Feggins
(74) *Attorney, Agent, or Firm* — Fay Sharpe LLP

(57) ABSTRACT

A side-firing printhead comprises a stack that includes a plurality of slices, wherein each slice includes a PCB trigger layer and a diaphragm layer, the PCB trigger layer controls the flow of ink from the diaphragm layer, a first side of the diaphragm layer includes at least one cavity that delivers ink via one or more aperture braces. An aperture plate is coupled to one side of the stack to interface to the diaphragm layers contained therein, wherein the aperture plate contains a plurality of apertures that are located at each aperture brace. A first bracket is disposed on the top of the stack and a second bracket is disposed on the bottom of the stack, wherein at least one fastener couples the second bracket to the first bracket such that a predetermined amount of pressure is applied to the stack.

20 Claims, 5 Drawing Sheets

STACKED SLICE PRINTHEAD

BACKGROUND

This application generally relates to design and production of custom printheads (e.g., side firing printheads). In one embodiment, printheads are fabricated by stacking slices, wherein the stack is held together via steel bracketing. It is to be appreciated, however, that the present exemplary embodiment is also amenable to other like applications.

In computing applications, there is a ubiquitous need to render electronic information into a tangible format. In such instances, a peripheral, such as a printer, can be employed to accept data from a computer, process the data and output the data as text and/or images onto a hardcopy substrate. A plurality of peripheral types can be employed to produce such hardcopy output including toner-based printers, solid ink printers, dye-sublimation printers, inkless printers and liquid inkjet printers.

Liquid inkjet printers operate by propelling variably-sized droplets of liquid or molten material (e.g., ink) onto a substrate. The inkjet printhead within the printer places droplets onto the substrate in one of three ways, via thermal, continuous and piezoelectric printhead cartridges. A thermal print cartridge utilizes a series of tiny electrically heated chambers, wherein a pulse of current through the heating elements causes a steam explosion in the chamber to form a bubble, which propels a droplet of ink onto the paper. Continuous inkjet cartridges utilize a high-pressure pump to direct liquid ink from a reservoir through a gun body, wherein a microscopic outlet creates a continuous stream of ink droplets. Piezoelectric cartridges use a piezoelectric material in an ink-filled chamber behind each outlet instead of a heating element. When a voltage is applied, the piezoelectric material changes shape or size, which generates a pressure pulse in the fluid forcing a droplet of ink from the outlet.

Piezoelectric inkjet technology is often used for marking in a manufacturing environment wherein the printhead is stationary as products move past it. Such print applications can require placement of information on a relatively precise location with an ever-decreasing size footprint. Information is rendered in hard copy format via placement of pixels in particular locations to create bar codes, text and/or images. To allow precise pixel placement, printheads are continuously designed and manufactured to emit ink from sub-micron sized apertures that are densely placed. Such inkjet printheads can be produced with modules arranged in a planar or stacked fashion, to maintain permissible dimensions and the packing density that can thereby be achieved to minimize manufacturing costs. In this design, slices of material (e.g., steel or other metal) are stacked wherein each slice performs a specific function.

In one example, some slices have cutouts to allow ink to be emitted from a plurality of predetermined locations. Other slices can contain piezoelectric circuits that control the delivery of ink to such apertures via one or several channels. Attention to precise adjustment is required to connect channels used to deliver ink through a number of modules. In addition, connecting channels of different lengths can require additional electronic control measures that can displace channels and/or change dimensional requirements for other components disposed within each layer.

Conventional designs of a stacked edge shooter printhead, such as those described in U.S. Pat. No. 5,850,240 (assigned to Francotyp-Postalia GmbH and incorporated herein by reference) can have many inadequacies that severely limit their use. For example, conventional designs are generally restricted to a resolution of 200 dpi that can be unsuitable for high resolution applications. Additionally, conventional printheads are designed for use at room temperature and thus can only be used with liquid ink systems. Moreover, conventional designs are limited to a small print width (e.g., one inch) that may obviate their use.

In addition, when an individual module malfunctions in a conventional stacked printhead, complicated assembly and adjustment can preclude its individual replacement and, consequently, a replacement of a complete inkjet printhead can be required. Due to the large number of outlets, these heads are significantly more expensive than inkjet printheads for standard office printers. Moreover, as size constraints increase, new design layouts can be required to meet specific print specifications. The generation of new printhead designs, however, can require a development cycle of two to three years or more.

To reduce this generational cycle and maintain stringent manufacturing standards, systems and methods are needed that utilize more standardized high-precision design paradigms.

CROSS REFERENCE TO RELATED PATENTS AND APPLICATIONS

U.S. Pat. No. 7,347,533 filed Dec. 20, 2004, entitled "Low Cost Piezo Printhead Based on Microfluidics in Printed Circuit Board and Screen-Printed Piezoelectrics" is incorporated herein by reference in its entirety. This patent is directed to a face-firing ink jet printhead based on PCB material.

BRIEF DESCRIPTION

In one aspect, a side-firing printhead comprises a stack that includes a plurality of slices, wherein each slice includes a PCB trigger layer and a diaphragm layer, the PCB trigger layer controls the flow of ink from the diaphragm layer, a first side of the diaphragm layer includes at least one cavity that delivers ink via one or more aperture braces. An aperture plate is coupled to one side of the stack to interface to the diaphragm layers contained therein, wherein the aperture plate contains a plurality of apertures that are located at each aperture brace. A first bracket is disposed on the top of the stack and a second bracket is disposed on the bottom of the stack, wherein at least one fastener couples the second bracket to the first bracket such that a predetermined amount of pressure is applied to the stack.

In another aspect, a printhead comprises a stack of slices, the stack has a top surface and a bottom surface. Each slice includes a diaphragm layer that receives ink from an external source via an inlet, stores the ink within a body coupled to the inlet and outputs the ink via an aperture brace. Each slice also includes a trigger layer that interfaces with the diaphragm layer to trigger the release of ink from the diaphragm layer. A first bracket is located on the top of the stack and a second bracket is located on the bottom of the stack. The second bracket is fastened to the first bracket to apply a predetermined amount of pressure to the stack.

In yet another aspect, a slice is utilized within a stacked slice printhead. A diaphragm layer stores and delivers ink, including a diaphragm laminate that holds an actuator and a cavity laminate that includes a body cavity that encloses the ink delivery channel within the slice. An adhesive layer couples the PZT spacer laminate to the cavity laminate adjacent to the PZT spacer laminate layer. A trigger layer includes an electrode, a signal is output from the electrode to the actuator to output ink from the diaphragm layer.

DETAILED DESCRIPTION

The presently described embodiments are directed to a stacked slice printhead, which selectively include 1) one or more brackets to maintain dimensional stability over a wide range of temperatures, 2) an improved aperture plate to match material thickness variation of slices within the printhead and 3) a constant diaphragm thickness.

A design methodology is employed to produce customized printheads quickly by outsourcing most or all of parts, construction, and assembly. Custom design parameters required for each slice can be specified via a computer software design package such as CAD or other similar program. Some designs can be manufactured utilizing techniques from other industries such as printed circuit board, personal computing and/or photo-chemical etching. Each of these exemplary industries offers quick turnaround of parts that meet high precision standards.

Stacked slice printheads can be fabricated utilizing a similar methodology to obtain high precision parts. These slices can be manufactured and utilized for various disparate designs on an as-needed basis. For example, a business may wish to manufacture seven different stacked slice printhead designs that have at least one common slice. Slices can be designed, fabricated and subsequently utilized in production for each of these printhead designs. This type of arrangement allows a printhead to be assembled from pre-fabricated components to build printheads with application specific parameters that utilize dissimilar circuit layouts, components and number of ink outlets, for example.

Figure 1:
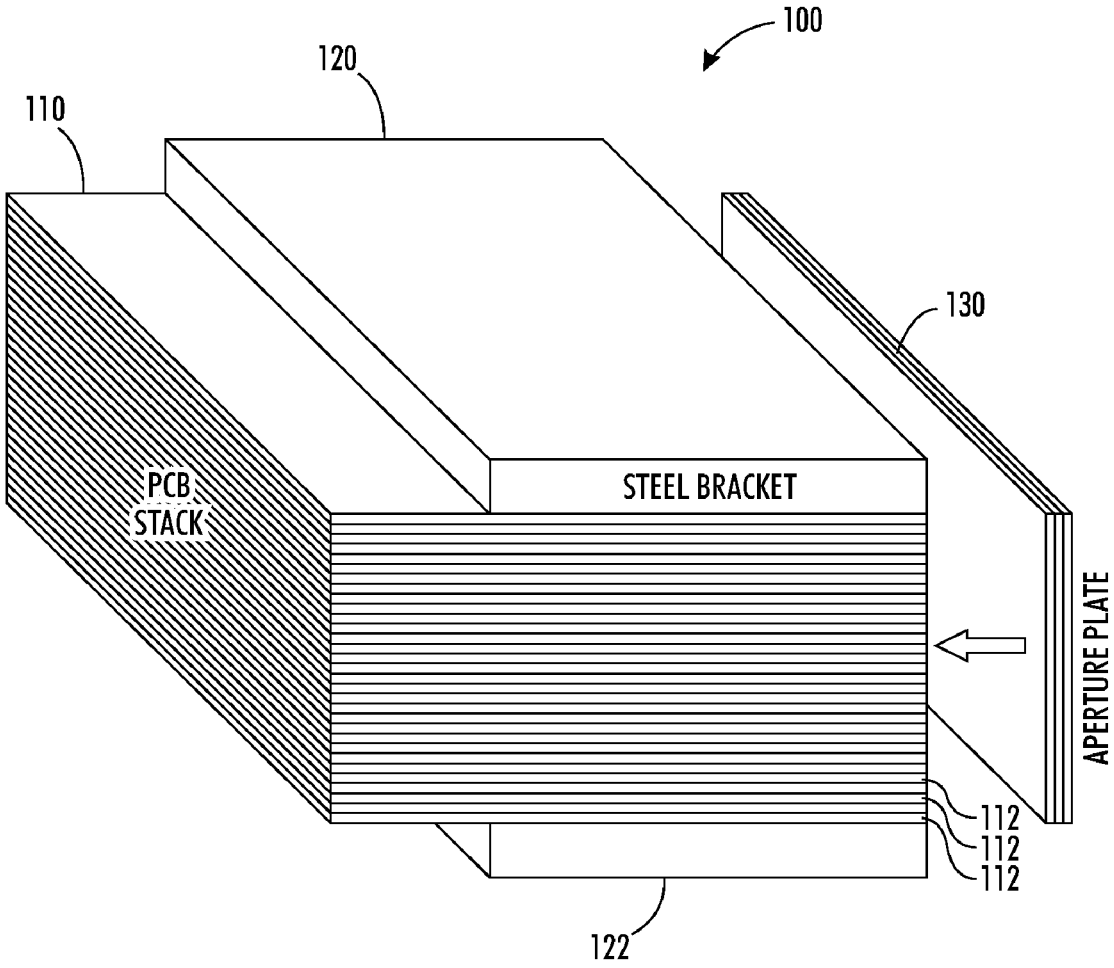
FIG. 1 illustrates a stacked slice printhead, in accordance with an exemplary embodiment.

FIG. 1 illustrates a sliced stack (e.g. side firing) printhead 100 that includes a stack 110 comprised of a plurality of slices 112. A first bracket 120 and a second bracket 122 are coupled together via at least one fastener (not shown) to bind the slices 112 together. An aperture plate 130 interfaces with the stack 110 to facilitate the delivery of ink onto a print target, such as a container or hardcopy substrate. In one approach, the aperture plate 130 is bonded to a face of the stack 110 to mate openings within the aperture plate 130 to corresponding outlets (not shown) at the edge of the one or more slices 112. Ink can be delivered from an external source (not shown) into one or more channels within and/or to link one or more slices 112 within the stacked slice printhead 100. From the channels, ink moves to the body and out of the aperture plate 130 to a print target as it is drawn past the printhead 100.

Each slice 112 is comprised of a diaphragm layer and a trigger layer. The diaphragm layer receives ink from an outside source and directs it to one or more apertures onto a print target. The trigger layer controls the diaphragm layer within the same slice. That is, ink is released from the diaphragm layer upon a command from the trigger layer. A metal surface on the back of a trigger layer also serves as a floor layer to facilitate storage ink within a body of a diaphragm layer, which belongs to an adjacent slice. The number of slices 112 within the printhead 100 can vary to accommodate any linear nozzle density (e.g., up to 1200 dpi). Further, the length of each slice can vary to accommodate a wide range of print widths (e.g., up to 17 inches).

Figure 2A:
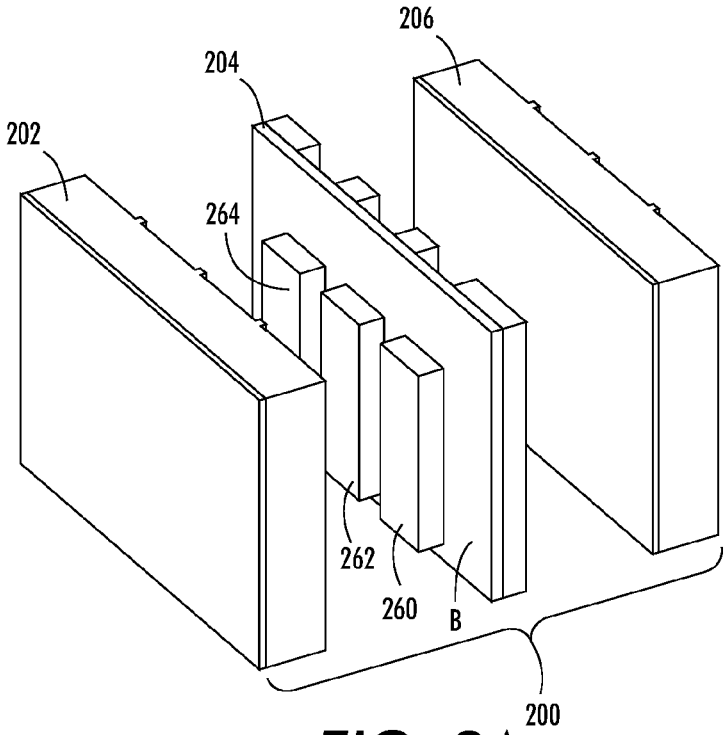
FIGS. 2A and 2B illustrate an isometric and a top view of a slice and an adjacent diaphragm layer, in accordance with an exemplary embodiment.
Figure 2B:
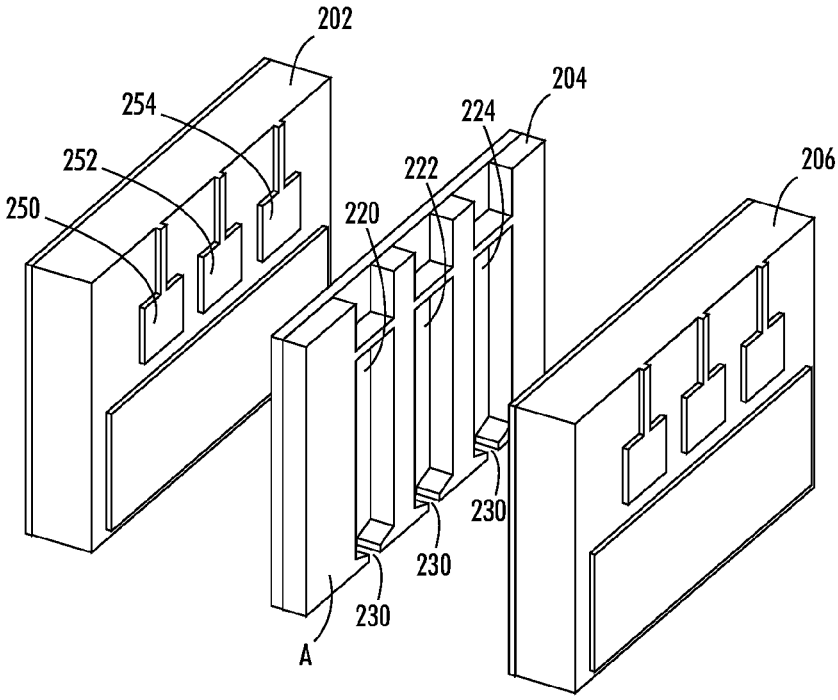

FIGS. 2A and 2B illustrate a left and a right isometric view respectively of a slice 200 comprised of a trigger layer 202, a diaphragm layer 204 and a floor layer 206 disposed proximate to one another as depicted. The three layers 202-206 work together to store and deliver ink as needed for various print modalities. In general, a side A of the diaphragm layer 204 is used to store ink in a plurality of cavities which are sealed via the adjacent floor layer 206. Side B of the diaphragm layer 204 contains a plurality of actuators that correspond to each of the cavities on side A. The actuators are triggered via the trigger layer 202 to release ink from one or more of the cavities.

The diaphragm layer 204, in this example, contains three ink delivery channels wherein each channel includes a cavity 220, 222 and 224 and an aperture brace 230, 232 and 234 at end of each cavity 220-224. The cavities 220-224 contain a predetermined volume for ink storage to meet particular application requirements. The aperture braces 230-234 facilitate delivery of ink from the body cavities 220-224 onto a substrate such as paper, plastic, velum, etc. via apertures within the aperture plate 130.

To deliver ink from each cavity 220-224, the trigger layer 202 employs electrodes 250, 252 and 254 coupled to actuators 260, 262 and 264 to trigger the diaphragm layer 204 via deformation caused by a piezoelectric effect. This deformation, in turn, modifies the volume and therefore pressure within the ink delivery channels of the diaphragm layer 204. This deformation is required to be consistent throughout the stack 110 in order to insure that an equal amount of ink is dispersed at a given time. To try and maintain a consistent deformation, it is imperative that the thickness of each diaphragm layer be the same across the entire array of cavities.

Materials utilized to fabricate each slice 112 within the printhead 100 can necessitate resiliency that is adequate to withstand repetitive deformation and temperature change without losing structural integrity, especially at narrow thicknesses. For example, printheads can be employed at high temperature (e.g., 150° C.) to accommodate a wide range of the ink types such as solid ink wax wherein thermal expansion occurs as the printhead 100 is heated to temperature. It is advantageous that a coefficient of thermal expansion (CTE) for each layer is compatible to insure that the stack 110, as a whole, can withstand stresses experienced by these materials. Differences in CTE from layer to layer (e.g., within each slice 112) can cause deleterious effects as the materials can expand and contract at different rates when exposed to similar temperatures. One initial symptom is delamination of the aperture plate 130 from the stack 110 when the former expands at a different rate from the latter. Accordingly, matching the CTE of the entire stack to the aperture plate 130 can contribute to the longevity of operation of the printhead 100.

Both inter-slice and intra-slice layers within the printhead 100 can be glued together via an adhesive film. In addition, with reference back to FIG. 1, a first bracket 120 and a second bracket 122 can be employed to bind together all layers within the stack 110. Substantially any fastener, such as bolts and nuts, is employed to fasten the first bracket 120 to the second bracket 122 with the slices 112 disposed therebetween. In one example, spring washers (e.g., Belleville) are used with the nuts on the bolts to maintain a predetermined clamping pressure at substantially any temperature, with the purpose of overwhelming the entire printhead 100 structure to expand and contract like a single unitary component. Utilizing such bracketing can allow dimensional stability of the printhead 100 to be maintained over a wide range of temperatures In one example, the diaphragm layer is made of stainless steel and the trigger layer is made of a PCB composite. It is to be appreciated, however, that substantially any material can be employed for layers that have compatible CTEs. Such compatibility can be identified when materials, which adhered together, act substantially as a unitary component. Similarly, the material used to fabricate the aperture plate 130 should have a CTE commensurate with that of the stack 110 as a whole. In this manner, the alignment of ink outlets from each slice can be maintained with apertures within the aperture plate 130.

The CTE of stainless steel is approximately 16 ppm/C, whereas a PCB composite has generally anisotropic CTE values. For a PCB composite, a plane CTE can be around 40 ppm/C whereas a thickness direction CTE can be around 100 ppm/C. As Young's Modulus of PCB material is less than one-tenth of stainless steel, the CTE mismatch problem is solved by binding the stainless and PCB layers between the first bracket 120 and the second bracket 122, as discussed above. Steel can be utilized to fabricate the first bracket 120 and the second bracket 122, although substantially any material with similar structural integrity is contemplated.

In one application, each slice 112 includes twenty-five outlets per inch. The stack 110 can include twenty-four slices 112 configured in this manner to provide a 600 outlet-per-inch printhead to be formed. In order to keep the first and the last outlet rows of the stack within a half inch in the process direction, each slice can be around 20 mils thick. Alternative designs are contemplated including those with placement schemes that provide a different skew order or schemes that do not form straight parallel columns. In this manner, outlets can be placed differently on a predetermined number of slices within the stack 110 to obtain desired ink output for each application. The applications can vary based on any number of parameters such as print target speed, footprint size, information density, etc.

Moreover, multiple printheads can be disposed adjacent to one another to accommodate a desired print window size and/or print target speed. For instance, for an 8-inch print window, 4800 outlets can be employed, wherein each column of outlet is skewed to accommodate target direction and speed. Each row of outlets can be shifted from the previous row by a predetermined distance (e.g., 1.667 mils) in the direction of target travel. In this manner, an outlet on the last slice in the stack 110 is the same distance away from an outlet on the next column located on the first slice of the stack.

To complete fabrication of the printhead 100, the aperture plate 130 is attached over a face of the stack 110 where the outlets (not shown) are populated. The cross-section of each outlet from the appropriate slices can be defined by PCB manufacturing limits and/or the thickness of the substrate used to fabricate each body chamber. In one example, 8 mils in the X direction and 5 mils in the Y direction can be achieved. The total layer used for slice fabrication thickness should not deviate more than +/−1.5 mils. Maintaining such a tolerance can allow the aperture plate 130 to be positioned so that the aperture openings (approximately 1.6 mils in diameter) are within a location tolerance at the middle of each outlet opening. In this manner, the aperture plate 130 can be matched to accommodate material thickness variation of slices within the printhead 100.

It is to be appreciated that the method of attaching the aperture plate 130 to the stack 110 is an important aspect of fabrication of the printhead 100. A typical thickness variation for a PCB is around +/−1.5 mils. Class 3 PCB boards generally have a reduced tolerance of around +/−1 mil. Such tolerance, however, implies that even if each slice 112 has a purely random variation from a thickness specification, the average total fluctuation of the stack 110 will exceed +/−5 mils for a 25-slice stack. Thus, maintaining outlet position in the Y direction to line up with the aperture opening is difficult if not impossible using conventional fabrication modalities. This is especially true with a single aperture plate design for all printheads.

This restriction can be eliminated by utilizing modern instrumentation equipment and driver electronics. Thus, instead of a single design for all printheads, the aperture plate 130 is designed and fabricated to accommodate design variations of the printhead 100. The aperture positions within the aperture plate 130 (generally 1-2 mils thick) are determined only after outlet positions of the stack 110 are measured. In one example, an automated motorized optical system, such as a Nikon VMR, is employed to measure a predetermined number of outlets within the stack 110. Afterward, positions of aperture and alignment openings on the aperture plate 130 can be interpolated and computed.

This data can be read by a laser cutter machine to create aperture openings in the appropriate locations in the aperture plate 130 to mate perfectly to the stack 110. Jetting electronics can also take the position data, particularly separation in the Y-direction, to determine timing delays to match drop firing speeds to print target (paper feed) speeds. The outlets can have predetermined sized openings (e.g., 8-mil wide by 4-mil tall) with a predetermined pitch (e.g., 40 mils), wherein each layer is offset from the layer below by a preset distance (e.g., 1.67 mils). When the aperture plate 130 is attached onto the stack 110, the much smaller apertures can be positioned at the centers of the rectangular outlet openings within each slice 112.

In operation, with reference to both FIGS. 1 and 2, ink is delivered to the body 220-224 and then pressurized by movements in the diaphragm caused by actuators 260-264. The pressurized ink is pushed through the outlet section 230-234 and stopped at the aperture plate 130. An opening (e.g., 40 microns in diameter) on the aperture plate 130 will allow a small amount of ink to push through at a high speed thereby ejecting the small stream of ink out of the aperture plate 130 onto the print target. While in flight, the stream coagulates back into an ink drop before contact with the print target.

The triggering is accomplished via electrodes 250-254 on the layer 202 that interface with each of the actuators 260-264. In one example, the actuators 260-264 are made from a piezoelectric material such as lead zirconate titanate (PZT), which physically change shape when an external electric field (e.g., change in voltage or current) is applied via the electrodes 250-254. The electrodes 250-254 are coupled to an application specific integrated circuit (ASIC) that is utilized to discern when to trigger the flow of ink through the each respective body 220-224. In one embodiment, the trigger layer is a PC board that carries the interconnect and/or the ASIC chips that generate the signals to drive the actuators 260-264. In the case that PC chips are mounted, a spacer bracket or equivalent can be employed on multiple layers of the board by extending (e.g., staggered) tabs from individual trigger layers at disparate lengthwise locations.

Figure 3:
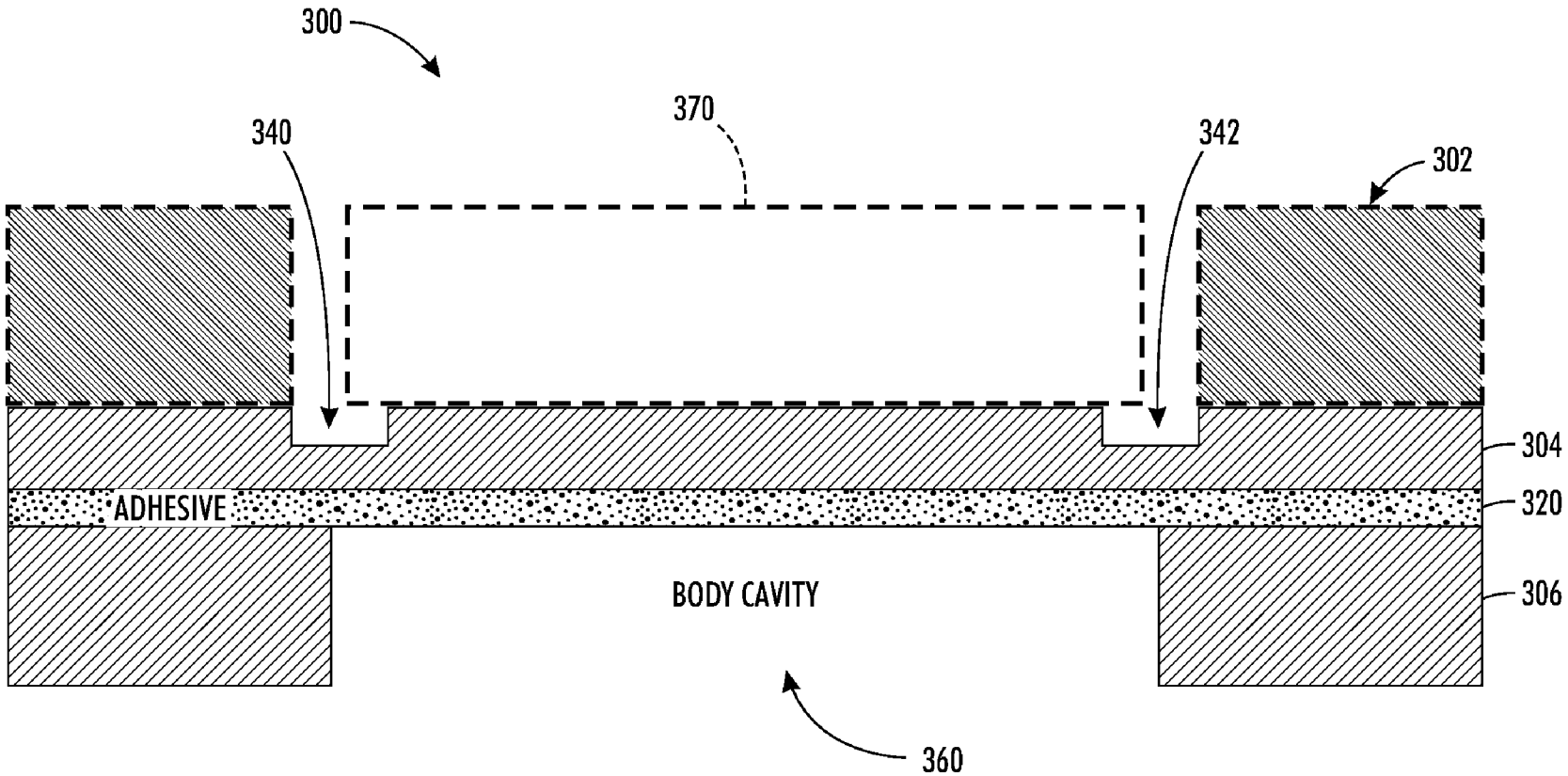
FIG. 3 illustrates a cross-section of a diaphragm layer within a stacked slice printhead, in accordance with an exemplary embodiment.

FIG. 3 shows an exemplary diaphragm layer 300, which is fabricated as a partially etched laminated piece of stainless steel. The diaphragm layer 300 includes a PZT spacer laminate 302 adjacent a diaphragm laminate 304. A cavity laminate 306 is coupled to the diaphragm laminate 304 via an adhesive layer 320. The PZT spacer laminate 302 includes a gap that is employed to accommodate the dimension of one of more actuators 370 seated on the diaphragm layer 300.

A first anchor point 340 and a second anchor point 342 are created for the actuators to mount to the diaphragm layer 300. In addition, a cavity 360 is created to complete each body within respective adjacent diaphragm layers. These features can be created utilizing a chemical etch process. A standard time-etch process within the photochemical etch is generally too inconsistent to insure a level of precision of material thickness that is repeatable from batch to batch. As an alternative, the ink delivery slices 202 and 206 can be fabricated via a partial etch method to provide an acceptable and repeatable level of precision.

One advantage of the subject exemplary embodiments is to maintain a constant diaphragm thickness. The tolerance of each layer 302, 304 and 320 can be highly precise (e.g., less than 1 mil deviation from a nominal value) to insure the overall printhead thickness variation is minimized. In one example, the diaphragm laminate 304 has a nominal thickness of around 2 mils and the cavity laminate 304 has a nominal thickness of around 4 mils, which are both made from 316 stainless steel shim stock. The adhesive layer 320 can have a nominal thickness of 1 mil and made from an epoxy film adhesive such as Krempel Akaflex CDF. To create the diaphragm layer 300, the laminates 304 and 306 and adhesive 320 can be clamped (e.g., at around 200 psi) and cured between 150-200 degrees C.

Once cured, the cavity 360 can be etched from the cavity laminate 306 of the diaphragm layer 300, which is masked and etched until the embedded adhesive layer 320 is visible. Similarly, partial etching is employed on the diaphragm laminate 304 to form an outline of the first anchor point 340 and the second anchor point 342. In this manner, the etching process is not altered while still obtaining a slice 300 thickness that meets or exceeds predetermined accuracy requirements.

Figure 4:
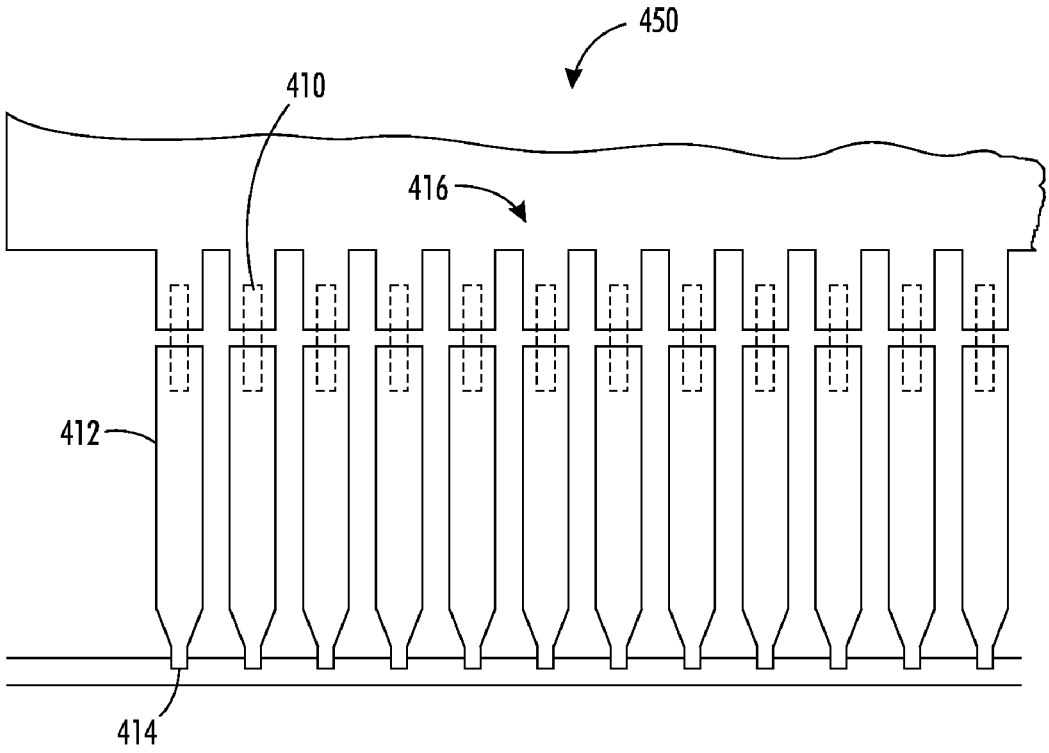
FIG. 4 illustrates a design of a cavity and adjoining adhesive within a stacked slice printhead, in accordance with an exemplary embodiment.

Referring now to FIG. 4, a plurality of features can be designed for fabrication including inlets 410, cavities 412 and aperture braces 414 from a single substrate 450. For example, a row of cavities approximately 150 mils long with a pitch of about 40 mils can be formed, wherein each cavity 412 is generally rectangular in shape. The substrate 450, as shown, can be representative of one side of the diaphragm layer 300 from FIG. 3, wherein the cavity 412 corresponds to the cavity laminate 306. It is to be appreciated that the opposite side (not shown) of the substrate 450 would correlate to the diaphragm laminate 304 and the anchor points 340, 342 in one embodiment.

In one approach, a large opening can bring ink in via the inlet 410 utilizing a multi-barbed tube fitting through the steel bracket 120 into a small flat reservoir 416 formed within the substrate 450. In this manner, ink can be distributed to different slices, and different colors can co-exist on adjacent slices. The inlet 410 can be formed above the blunt end of the cavity 412 as a surface feature on the PC board that will mate onto the cavities. Alternatively, inlet 410 can be formed as laser-cut feature on a plastic or Teflon gasket sheet. The aperture brace 414 can be formed at the tapered end after removal of 15 mils of materials at a tip portion, in one example.

Figure 5:
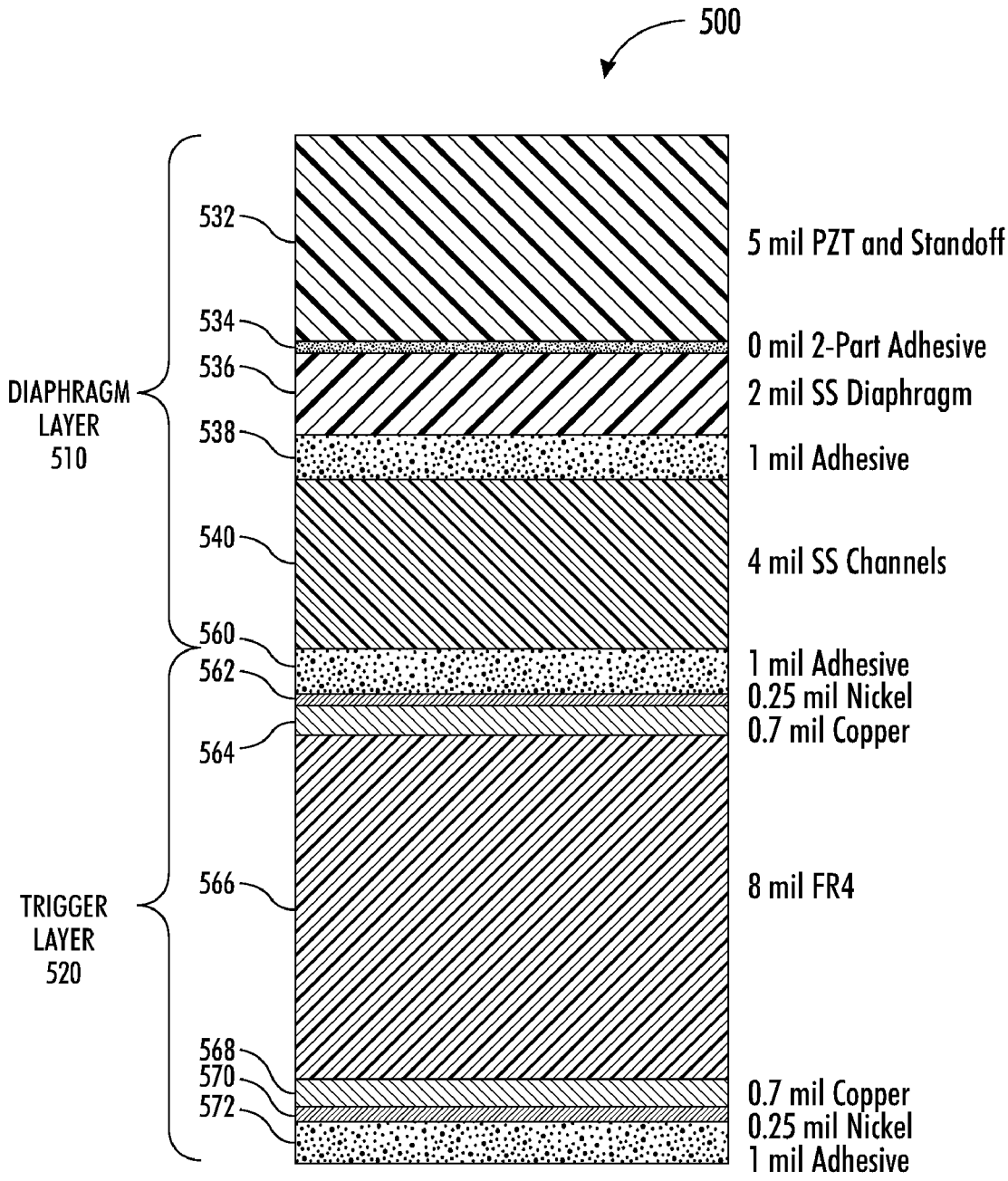
FIG. 5 illustrates a cross-section of a layer within a stacked slice printhead, in accordance with an exemplary embodiment.

FIG. 5 illustrates a cross-section of a slice 500 utilized in a stacked slice printhead, such as the printhead 100 discussed above. The slice 500 includes a diaphragm layer 510 and a trigger layer 520. The thickness of each layer within the slice 500 can impact the location of outlets within the sliced stack printhead. As such, maintaining consistent layer thicknesses is important to provide reliable print output. The selection of high precision components can insure that a predetermined tolerance level is met for the thickness of the slice 500. In one example, the slice 500 is 23.2 to 24.2 mils thick.

The diaphragm layer 510 includes a PZT and standoff 532 that is approximately 5 mils thick. This thickness takes into account the height of actuators utilized to trigger delivery of ink within an adjacent ink delivery slice 540, such as the slice 304. The PZT is placed directly onto the diaphragm layer 536 via a 2-part adhesive 534 (e.g., PD bond, Tra-Bond BA-F113, etc.), which has no measurable thickness. An adhesive layer 538 (320 in FIG. 3), approximately 1 mil thick, is used to couple the diaphragm layer 536 to a cavity layer 540 (306 in FIG. 3), approximately 4 mils thick.

The diaphragm layer 510 is coupled to the trigger layer 520 via an adhesive layer 560, approximately 1 mil thick. In one embodiment, the adhesive layer 560 is a sheet of plastic used to form the inlets 410 depicted in FIG. 4. The trigger layer 520 is a PCB in this example, which has a conductor-insulator-conductor cross section. A first nickel layer 562 and a first copper layer 564 serve as a first conductor and a floor layer to the ink cavities 540. The first conductor layer 562 and 564 may also carry signal traces thus requiring it be insulated from 540 by an insulator 560.

An FR4 layer 566 serves as an insulator underneath the copper layer and is about 8 mils thick. A second copper layer 568 and a second nickel layer 570 comprise the second conductor. An adhesive layer 572 is provided to couple the slice 500 to another slice (not shown). It is to be appreciated that layers can be added or removed from this exemplar. Further, the materials specified can be modified to meet alternate specifications.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A side-firing printhead, comprising:

a stack that includes a plurality of slices, wherein each slice includes a PCB trigger layer and a diaphragm layer, the PCB trigger layer controls the flow of ink from the diaphragm layer, a first side of the diaphragm layer includes at least one cavity that delivers ink via one or more aperture braces;

an aperture plate that is coupled to one side of the stack to interface to the diaphragm layers contained therein, wherein the aperture plate contains a plurality of apertures that are located at each aperture brace;

a first bracket disposed on the top of the stack; and a second bracket disposed on the bottom of the stack, wherein at least one fastener couples the second bracket to the first bracket such that a predetermined amount of pressure is applied to the stack.

2. The printhead according to claim 1, the diaphragm channel further including:

an inlet that receives ink from an external source;

a body that interfaces to the inlet to store the ink received; and an aperture brace that interfaces with the body to facilitate output of the ink from the diaphragm layer when a command is received from the diaphragm layer.

3. The printhead according to claim 2, the diaphragm layer includes a body cavity on a first side that is enclosed via a floor layer directly adjacent the diaphragm layer.

4. The printhead of claim 2, wherein the diaphragm layer includes an actuator for each ink delivery channel, the actuator is mounted to a second side of the diaphragm layer opposite the first side.

5. The printhead according to claim 4, the actuator is made of a piezoelectric material and is triggered via an electrode of an ink delivery slice of a directly adjacent disparate slice.

6. The printhead according to claim 4, wherein the actuator deforms the body cavity to change at least one of a volume and a pressure within the ink delivery channel to output ink from the body via the aperture brace.

7. The printhead according to claim 4 further including an electrode that corresponds to each inlet body and aperture brace, the at least one electrode is located on the side opposite the inlet body and aperture brace.

8. The printhead according to claim 1 wherein the diaphragm layer is made of laminated stainless steel.

9. The printhead according to claim 1, wherein the diaphragm layer further includes:

a diaphragm laminate that holds an actuator;

a cavity laminate that includes a body cavity that encloses the ink delivery channel within the slice; and an adhesive layer that couples the PZT spacer laminate to the cavity laminate adjacent to the PZT spacer laminate layer.

10. The printhead according to claim 9, wherein the PZT spacer laminate includes at least one chemically etched anchor point that is utilized to mount at least one actuator to the diaphragm layer.

11. The printhead according to claim 9, wherein the body cavity is created by removal of a portion of the cavity laminate down to the adhesive layer via a photochemical etch process.

12. The printhead according to claim 1 further including an aperture plate that mounts to one side of the slice stack, the aperture plate contains an aperture for each of the aperture braces contained within the slices.

13. A printhead, comprising:

a stack of slices, the stack has a top surface and a bottom surface, wherein each slice comprises:

a diaphragm layer that receives ink from an external source via an inlet, stores the ink within a body coupled to the inlet and outputs the ink via an aperture brace;

a trigger layer that interfaces with the diaphragm layer to trigger the release of ink from the diaphragm layer;

a first bracket located on the top of the stack; and a second bracket located on the bottom of the stack, the second bracket is fastened to the first bracket to apply a predetermined amount of pressure to the stack.

14. The printhead according to claim 13, wherein the diaphragm layer includes at least one body cavity created by removal of a portion of the cavity laminate down to the adhesive layer via a photochemical etch process.

15. The printhead according to claim 13, wherein the diaphragm layer further includes:

a diaphragm laminate that holds an actuator;

a cavity laminate that includes a body cavity that encloses the ink delivery channel within the slice; and an adhesive layer that couples the PZT spacer laminate to the cavity layer adjacent to the PZT spacer laminate layer.

16. The printhead according to claim 15, wherein the PZT spacer laminate includes at least one chemically etched anchor point that is utilized to mount at least one actuator to the diaphragm layer.

17. The printhead according to claim 13, wherein the first bracket and the second bracket are made of steel.

18. The printhead according to claim 13, wherein the first bracket is coupled to the second bracket via at least one bolt, wherein each of the at least one bolt includes a spring washer and a nut located on a distal side of the bolt head.

19. A slice that is utilized within a stacked slice printhead, comprising:

a diaphragm layer that stores and delivers ink, including, a diaphragm laminate that holds an actuator;

a cavity laminate that includes a body cavity that encloses the ink delivery channel within the slice; and an adhesive layer that couples the PZT spacer laminate to the cavity laminate adjacent to the PZT spacer laminate layer; and a trigger layer that includes an electrode, a signal is output from the electrode to the actuator to output ink from the diaphragm layer.

20. The slice according to claim 19, further including:

one or more anchor points created via a chemical etch process on the diaphragm laminate, the anchor points are employed to hold the actuator; and a body cavity created via a chemical etch process to remove material from the cavity laminate until the adhesive layer is reached.

* * * * *